United States Patent [19]

Chitouras

[11] 4,238,526

[45] Dec. 9, 1980

[54] METHOD OF COATING OBJECTS

[76] Inventor: Costa G. Chitouras, 10 Packard Ave., Somerville, Mass. 02144

[21] Appl. No.: 72,107

[22] Filed: Sep. 4, 1979

[51] Int. Cl.[3] ..... B05D 3/06

[52] U.S. Cl. ..... 427/44; 118/500; 118/503; 156/272; 156/279; 273/61 B; 427/25; 427/33; 427/206

[58] Field of Search ..... 427/44, 25, 206, 33; 156/272, 279; 118/500, 503; 273/61 R, 61 B

[56] References Cited

U.S. PATENT DOCUMENTS

| | | | |
|---|---|---|---|
| 2,569,705 | 10/1951 | Briggs et al. | 118/503 |
| 3,025,587 | 3/1962 | Seidel | 273/61 R |
| 3,724,421 | 4/1973 | Schneck et al. | 427/206 |
| 3,903,331 | 9/1975 | Klein | 427/206 |
| 3,904,201 | 9/1975 | Henry | 273/61 B |
| 3,922,410 | 11/1975 | Halloran | 427/206 |
| 4,100,311 | 7/1978 | Nablo et al. | 427/44 |

*Primary Examiner*—John H. Newsome
*Attorney, Agent, or Firm*—Kenway & Jenney

[57] ABSTRACT

A three-dimensional object is flocked by applying an adhesive to it, supporting it on a first side while applying fibers to the second side, and then curing the adhesive on most of the second side by directing a low energy electron beam at it that does not penetrate and cure the adhesive on the first side. The object is then supported on the second, cured, side while fibers are applied to the uncured first side, and then the electron beam is applied to cure the first side also.

8 Claims, 9 Drawing Figures

METHOD OF COATING OBJECTS

BACKGROUND OF THE INVENTION

The invention relates generally to methods for coating objects and particularly to methods for applying flock to all of the surface of an object without leaving support marks.

Whenever a three dimensional object is supported while a coating of material is applied, there are invariably areas of the object's surface that are not coated because they were shielded by the support. The problem is not always serious. If a first coat leaves gaps in coverage the object may be supported elsewhere and a second coat may be applied to the surface area that includes the gaps. This solution is suitable if the overlap of the first coat by the second that is bound to occur does not detract from the overall appearance or function of the object. If the overlapping of coats that results from this method does detract from the appearance or function of the object, the method is obviously not suitable.

The gaps could be avoided altogether by supporting the object without physically contacting its surface. However, techniques for this, such as air cushion supports, magnetic suspensions, and electrostatic suspensions, are difficult and expensive, and not suitable or practical for many objects. The gaps can also be minimized, by using support structures such as pins that greatly reduce the area shielded from coating. For some purposes, the small gaps in the coating that result may be acceptable.

For some forms of coating, overlapping coats are not suitable, and even minimal support marks are undesirable. Flocking is an example of such a coating. In flocking, fibers are deposited by mechanical or electrostatic methods on an adhesive coated surface, the ends of the fibers being imbedded in the uncured adhesive. The adhesive is then cured or set. Since the process has two steps, and the flocking has a texture, overlapping "coats" of flocking would be unacceptable. Any gaps in flocking tend to be obvious, particularly where the flocked fibers are long, since the texture of the surface created by the flocking exaggerates the impression the gaps make. A flocked tennis ball, for example, may be produced by automatic machinery to provide an inexpensive substitute for the traditional tennis ball in which the covering is applied by hand if the flock surface can be obtained unmarred by defects caused by supports.

In my co-pending application, Ser. No. 744,941, filed Nov. 24, 1976, I have set forth a method of flocking in which I cured the adhesive in which the fibers are embedded by an electron beam of relatively low energy. It is an object of this invention to provide a method for applying coatings such as flocking to three dimensional objects without leaving unsightly support marks. It is another object to use electron beam curing to provide for applying coatings such as flocking to objects in a way that makes supporting the object during the coating process simple and secure. Other objects of the invention will be pointed out, or be inherent, in the following description of the invention.

SUMMARY OF THE INVENTION

The invention comprises applying an electron beam curable coating to the surface of an object, supporting it at a location, and applying an electron beam to cure the coating except for a portion including the support location. Then the object is supported at another location in the cured portion and the remaining portion of the coating is cured by applying the electron beam.

In preferred embodiments the method is used to flock objects without leaving support marks, by first applying an electron beam curable adhesive to the entire surface of the object. The object is then supported by a support means contacting a surface portion of a first side of the object at a location remote from the second side. Fibers are then applied to the second side and areas of the first side adjacent the second side, and the second side is cured by directing an electron beam at it. The object is then supported at a location on the second side, fibers are applied to the remainder of the first side, and an electron beam is applied to the first side to cure the previously uncured adhesive there, automatically completing the coating process.

BRIEF DESCRIPTION OF THE DRAWINGS

Other objects, features, and advantages will be apparent from the following description, including the drawings, in which.

DESCRIPTION OF A PREFERRED EMBODIMENT

The figures show the application of flocking to a rubber ball 10 to give it the textured surface that would allow, for example, its use as a tennis ball. The method of the invention could be applied to a wide variety of objects, but the example of a tennis ball is particularly appropriate. In order for a tennis ball to be flocked in this manner and function well, the flocking must be applied evenly to the entire surface. Unsightly gaps in the flocking must be minimized.

Figure 1:
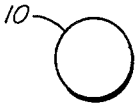
FIGS. 1 to 9 illustrate, diagrammatically, the steps of flocking a tennis ball using the method embodying the invention.
Figure 2:
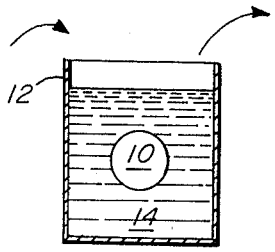

The first step in flocking the ball 10, shown in FIG. 1, is to dip the ball in a tank 12 containing liquid adhesive 14, as shown in FIG. 2. The adhesive 14 is applied to the entire surface of the ball 10. The adhesive is the kind used to bind flock, and is curable by the application of an electron beam of low energy. The adhesive would be radiation curable, perhaps from the urethane family, compounded to adhere to the rubber ball and flock, and to be flexible enough to adhere even when the ball is distorted. Such adhesives are available from many sources. One example of such an adhesive is that sold by Hughson Chemicals, of Erie, Pennsylvania, and designated by that company as RD 3420-17.

Figure 3:
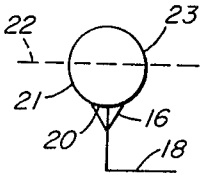

Referring to FIG. 3, it can be seen that the adhesive covered ball 10 is then rested on a triangular support 16 extending upward from an arm 18 mounted on some outside support for instance (not shown). The triangular support 16 is fairly narrow, and supports a ball 10 at a location 20 on the bottom side 21 of the ball. An imaginary equator 22 separates the top side 23 of the ball from the bottom side 21. The elements of the support 16 are spread apart enough to form a stable platform for the ball 10, but they are still spaced remotely from the equator 22 dividing the top and bottom sides of the ball.

Figure 4:
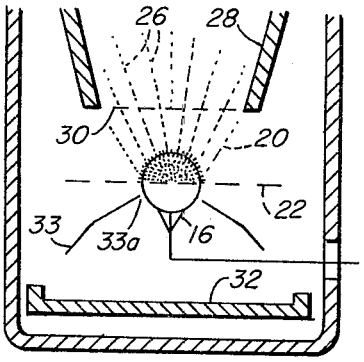

In the next step shown in FIG. 4, fibers 26 are applied electrostatically to the top side 23 and adjacent portions of the bottom side 21 of the ball 10. The method of application is conventional. A container 28 is loaded with a flock material 26 to be deposited on the ball's surface. An energizing screen 30 is provided at the lower end of the container 28, and a collecting member 32 is provided below the ball 10. The ball is supported in position by the support 16. A high D.C. voltage is applied between the energizing screen 30 and the triangular support 16 and the bottom trough or collector 32 in order to orient and propel the fibers 26 onto the adhesive covered ball 10.

The entire surface of the ball is not covered with fibers. The electrostatic field is controlled by suitably shaped barriers of the appropriate voltages to direct the fibers primarily to a portion of the surface of the ball 10. In the illustrated embodiment, a metal baffle 33 extends outwardly from a circular interior edge 33*a* adjacent the ball 10 below the equator 22. The baffle 33 is either grounded or held at some other voltage suitable for limiting the electrostatic field so that the fibers 26 are directed to the top side 23 of the ball and portions of the bottom side 21 that are adjacent the top side. In other words slightly more than half the ball has fibers applied to it. The area including the location 20, where the support 16 contacts the surface of the ball 10, is kept essentially free of fibers.

Figure 5:
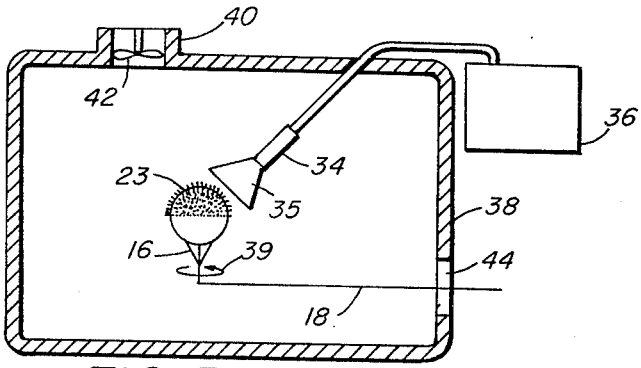

In the next step, as shown in FIG. 5, a portion of the adhesive 14 covering the ball 10 and having fibers embedded in it is cured. The ball 10 is placed, still on its support 16, under an electron beam producing gun 34 scanning horn 35 and power supply 36 within a radiation proof shielding enclosure 38. In the embodiment shown here, the support 16 for the ball 10 is shown as rotatable, in the direction of the arrow 39, about the joint with the arm 18. This allows the scanning horn 35 to be directed at the ball 10 from an angular position, making more efficient use of the horn. The enclosure 38 includes an outlet duct 40 with a fan 42 for dissipating ozone created by electron beam, and a slit 44 for inserting the ball 10.

The electron beam apparatus is conventional and may be any of the low voltage models, for example EPS-300-25-18-C, manufactured by High Voltage Engineering Corporation of Burlington, Massachusetts. Such a machine may be adjusted to produce an electron beam with a nominal energy level of 250 kev. to 300 Kev as well as an adjustable angle of exit or sweep of the electrons from the scanning horn 35. The dosage required for curing is a function of the adhesive used; the dosage received is determined by the time of application of the electron beam and by the magnitude of the beam intensity.

The beam of low energy described above will penetrate the flocking on the top side 23 of the ball 10 and cure the portion of the adhesive 14 there, the energy level required being approximately equal to that required to cure the adhesive without the flock present, as disclosed in my co-pending application previously cited. The beam will not penetrate into the ball 10 itself, and hence will not cure the adhesive 14 on the bottom side 21 of the ball 10. As a result there is a band of uncured adhesive with flock embedded in it between the cured, flocked, adhesive on the top side 21 and the uncured, unflocked, adhesive on the bottom side 23. This selective curing of the adhesive 14 is a unique characteristic of electron beam curing. It would not be possible, for example, with thermal curing or curing derived from catalyst-resin mixing.

Figure 6:
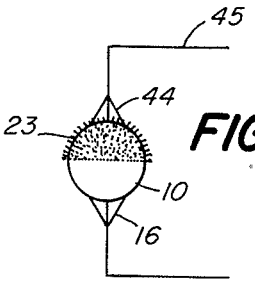
Figure 7:
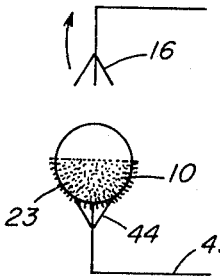
Figure 8:
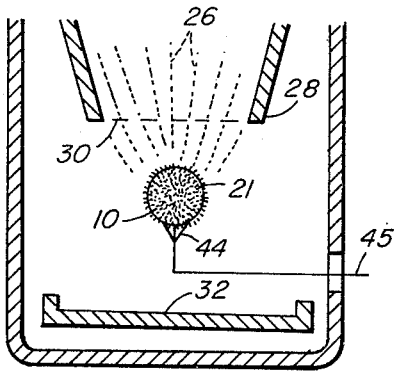

In the next step, shown in FIG. 6, another three point support 44, rotatable about a joint with an arm 45, is set on the top side 23 of the ball 10. Then, as shown in FIG. 7, the two supports 16 and 44 and the ball 10 are rotated 180°, and the bottom support 16, brought around to the top, is removed. The ball is now supported by the triangular support 44 contacting it on the previously flocked and cured portion of the ball's surface.

In the next step the ball 10 is inserted in the flocking apparatus and an electrostatic field is created to propel fibers 26 toward the bottom side 21, now on top. The entire ball 10 will now be covered by fibers. By the nature of the electrostatic application of the fibers they will be distributed evenly. To the extent that fibers 26 are directed by the field to portions already imbedded with fibers, the extra fibers so directed will simply not take hold. Furthermore, there will be no gaps in adhesive 14 left by the contact of support 16. The adhesive selected is a self-leveling type, so that once the pressure of the support 16 is removed, the adhesive 14 will tend to cover the surface where the support 16 is contacted. Alternatively, additional adhesive 14 can be added to the location 20 to cover any gaps left by the first support 16. The result of this second application of fibers 26, then, will be that the ball is entirely covered with adhesive 14 and fibers 26. Only the top side 23, now on the bottom, has had its adhesive cured. The bottom side 21, now on the top, is covered with fibers but the adhesive in which they are embedded is not yet cured.

Figure 9:
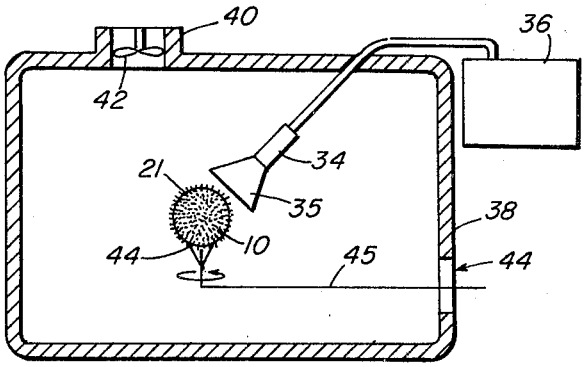

In the next step shown in FIG. 9, curing of the adhesive 14 is completed by placing the ball 10 in the electron beam enclosure 38 and directing the electron beam from the scanning horn 35 toward the bottom side 21 in the same manner as was done in the previous step in which the top side 23 was cured. The remainder of the adhesive 14 is thereby cured and the ball 10 is now completely covered with flocking held by the cured adhesive 14.

The result of using the method described above is a ball completely covered with flocking uniformly distributed, and with no gaps in the distribution of the flocking. The method described for coating this ball 10 with a coating of adhesive and flocking is illustrative of the invention. Various modifications, alterations, and deletions to the illustrated method may be made by those skilled in the art. For example, the adhesive 14 can be initially applied to an object by other methods besides dipping, such as spraying. The support 16 and later the support 44, were merely examples. Any support capable of holding an object in some stable manner, such as a hollow tube, would be satisfactory. The two step method of applying adhesive and the flocking was shown in the illustrated embodiment because its complexity makes the method of the invention particularly useful. But the method of the invention may be used when only one coating is applied to an object. Variations of the method illustrated are therefore contemplated and the scope of the invention is not meant to be limited by the embodiment shown but is to be defined by the following claims.

I claim:

1. A method of coating objects comprising the steps of:

(a) applying an electron beam curable coating to the surface of said object (b) supportably contacting said object at a first location, (c) applying an electron beam to said object to cure a portion of said coating exclusive of an area including said first location, (d) supportably contacting said object at a second location in said cured portion of said coating, and (e) applying an electron beam to said object to cure the remaining portion of said coating.

2. The method of coating objects as claimed in claim 1 in which step (a) comprises applying an electron beam curable coating to the entire surface of said object.

3. The method of coating objects as claimed in claim 1 including the further step of applying additional coating to said area including said first location, before step (e).

4. A method of flocking the entire surface of an object having a first and a second side comprising the steps of:

(a) applying an electron beam curable adhesive to the surface of said object,
(b) supportably contacting said object at a location on said first side of said object,
(c) applying fibers to said second side,
(d) directing an electron beam at said second side to cure said adhesive on said second side,
(e) supporting said object on said second side,
(f) applying fibers to said first side, and
(g) applying an electron beam to said object to cure the remainder of said adhesive.

5. The method of flocking objects as claimed in claim 4 in which step (b) comprises supportably contacting said object at a location on said first side of said object, remote from said second side.

6. The method of flocking objects as claimed in claim 5 in which step (c) comprises applying fibers to said second side and areas of said first side adjacent said second side.

7. The method of flocking objects as claimed in claim 4 in which step (d) comprises directing an electron beam of low energy at said second side to cure said adhesive only on said second side.

8. A method of flocking the entire surface of an object having a first and second side comprising the steps of:

(a) applying an electron beam curable adhesive to the surface of said object,
(b) supportably contacting said object at a location on said first side of said object, remote from said second side,
(c) applying fibers to said second side and areas of said first side adjacent said second side,
(d) directing an electron beam at said second side, said beam having energy high enough to cure said adhesive on said second side and low enough not to pass through said second side and cure said adhesive on said first side,
(e) supporting said object on said second side,
(f) applying fibers to said first side, and
(g) applying an electron beam to said object to cure the remainder of said adhesive.

* * * * *